United States Patent [19]

Fukae et al.

[11] Patent Number: 4,841,334

[45] Date of Patent: Jun. 20, 1989

[54] ELECTROGRAPHIC PRINTER WITH SMALL DIAMETER DRUM AND CHARGED TRANSFER BELT

[75] Inventors: Kensuke Fukae, Monsey, N.Y.; Shozo Kaieda, Nagano, Japan

[73] Assignee: Kentek Information Systems, Inc., Allendale, N.J.

[21] Appl. No.: 78,861

[22] Filed: Jul. 28, 1987

[51] Int. Cl.[4] ..... G03G 15/00

[52] U.S. Cl. ..... 355/271; 355/309; 355/315

[58] Field of Search ..... 355/3 TR, 14 TR, 3 SH, 355/14 SH, 3 R

[56] References Cited

U.S. PATENT DOCUMENTS

| | | | |
|---|---|---|---|
| 3,907,421 | 9/1975 | Jordan et al. | 355/3 R |
| 4,264,186 | 4/1981 | Fujiwara et al. . | |
| 4,407,580 | 10/1983 | Hashimoto et al. | 355/3 TR |
| 4,412,732 | 11/1983 | Ogata et al. | 355/3 TR |
| 4,417,800 | 11/1983 | Hirose et al. | 355/3 TR |
| 4,419,005 | 12/1983 | Kuehnle | 355/3 TR |
| 4,461,563 | 7/1984 | Favata . | |
| 4,478,924 | 10/1984 | Moraw et al. | 355/3 TR X |
| 4,588,279 | 5/1986 | Fukuchi et al. | 355/3 TR |

FOREIGN PATENT DOCUMENTS 62-151871 7/1987 Japan .

OTHER PUBLICATIONS

Alfred Poor, "The Ricoh Engine: Petite and Powerful", PC Magazine, Apr. 28, 1987, p. 125.

*Primary Examiner*—A. C. Prescott

*Attorney, Agent, or Firm*—Marmorek, Guttman & Rubenstein

[57] ABSTRACT

An electrographic printing apparatus includes a housing, a source of paper, an output receptacle for receiving the paper after it is imprinted, a photoconductive member for storing a latent electrostatic image, a developer unit for developing the latent electrostatic image, and a charged transfer belt disposed opposite the photoconductive member. The charged transfer belt serves to transfer the developed image from the photoconductive member to the paper, and to transport the paper after it is imprinted to a fusing station. The paper path is located near the top of the housing for easy access in case of a paper jam. The paper path includes a sharp separation angle from the photoconductive member in order to decrease the dwell time of the paper against the photoconductive member. Desirably, the photoconductive member comprises a photosensitive drum of relatively small diameter, for example, on the order of 30–80 mm in diameter.

41 Claims, 1 Drawing Sheet

ELECTROGRAPHIC PRINTER WITH SMALL DIAMETER DRUM AND CHARGED TRANSFER BELT

BACKGROUND OF THE INVENTION

This invention relates to an electrographic printer having a paper path near the top of the printer, a small diameter photoconductive drum and a charged transfer belt associated with the drum. The charged transfer belt is positioned opposite the photoconductive drum and functions to transfer a developed image from the photoconductive drum to a sheet of paper. The charged transfer belt also functions to transport the imprinted sheet of paper to a fusing station. The drum is seamless and therefore printing may begin at any position on the drum. The electrographic printer of this invention is particularly suitable for continuous printing as in a desktop publishing environment.

In the process of electrographic or xerographic printing, a photoconductive member is employed to record an image. The photoconductive member, which may be in the form of a belt or a drum, is charged to a substantially uniform potential to sensitize its photosensitive surface. In the case of a copying machine, a light is shined on an original document to be copied. Through the use of lenses, mirrors, and various other optical components, the charged portion of the photoconductive surface is exposed to a reflected light image of an original document to be reproduced. The light image is recorded as an electrostatic latent image on the photoconductive member. This latent image corresponds to the informational areas contained on the original document.

In the case of an electrographic printer connected to a computer, a similar process is used to record information on the photoconductive member. The charged portion of the photoconductive surface is exposed to a light image produced by an optical print head. The precise shape of the light image is controlled by input signals from the computer. For example, a laser or an LED array may be used as an optical print head which receives input signals from the computer to illuminate the photoconductive member with a light image of a particular shape. Here too, an electrostatic latent image corresponding to the desired informational areas is recorded on the photoconductive member.

After recording the electrostatic latent image on the photoconductive member, the latent image is developed by bringing a developer material or toner into contact with it. The developer material is attracted to the electrostatic latent image and forms a developed or powder image on the photoconductive member corresponding to the electrostatic latent image. The powder image is subsequently transferred to a sheet of recording medium, such as a sheet of paper, in a transfer region. Thereafter, the powder image is permanently affixed to this sheet in image configuration by a variety of methods, such as by fusing.

The above-mentioned operations may be carried out by arranging a number of stations in sequence about the photoconductive member. Thus, the photoconductive member is usually surrounded in sequence by a charging station to charge the photoconductive member, an imaging station to form an electrostatic latent image on the photoconductive member, a developing station to develop the electrostatic latent image on the photoconductive member, and a transfer station to transfer the developed image from the photoconductive member to the sheet of recording medium. A discharging station and a cleaning station are also arranged about the photoconductive member to ready it for use again.

The assignee of the present application has filed a number of patent applications which disclose and claim an electrographic printing apparatus, and various components thereof, operating in accordance with the aforementioned principles. The electrographic printing apparatus is disclosed in U.S. Pat. No. 4,664,507, issued May 12, 1987. The electrographic printer/copier described in that patent employs a photoconductive belt assembly in the form of a disposable cassette. The photoconductive belt assembly is disclosed in U.S. Pat. No. 4,657,369, issued Apr. 14, 1987. The printer/copier described in U.S. Pat. No. 4,664,507 also employs the combined developing and cleaning unit which is the subject of U.S. Pat. No. 4,639,116, issued Jan. 27, 1987. All of the aforementioned patents are assigned to the present assignee and all are incorporated herein by reference.

The electrographic printer/copier described in U.S. Pat. No. 4,664,507 has a simplified paper path permitting access from the top of the machine. The paper path is substantially planar and is located directly below the top of the machine. In that electrographic printer/copier, the cassette containing the photoconductive belt is mounted vertically within the machine and a latent image is developed on the underside of the copy sheet as it passes over and comes in contact with the top of the photoconductive belt assembly.

The electrographic printer/copier described in that patent requires two rotations of the photoconductive belt per copy produced. In actual practice, it is capable of producing about 12 copies per minute. During the first rotation of the photoconductive belt, the belt is uniformly charged and a latent image is generated by means of an optical print head on the surface of the photoconductive belt. The latent image thus formed is developed by the deposition of toner from a combined developer/cleaning unit operating in the develop mode. The belt then enters the transfer region wherein the developed image is transferred to the underside of the paper or other copy material. In the transfer region, a transfer unit generates an electrical field which attracts the toner from the photoconductive belt to the underside of the paper. This completes the first rotation of the belt as the paper is transported to a fusing station by means of a vacuum transport unit attached to the lid of the machine. The vacuum transport unit is in contact with the upper side of the paper only. Smudging is thereby avoided since the developed image is on the underside of the paper.

During the next revolution of the belt, the belt is prepared for making the next copy. The main charging unit and the optical print head are disabled while an erase lamp is activated and the developer/cleaner unit is switched to the clean mode. Thus, as the belt continues to rotate following image transfer, the photoconductive belt is discharged by an erase lamp and the excess toner is removed using a conventional electrostatic process by the developer/cleaner unit. The belt is thereby readied for printing on the next page.

One of the primary objects of the electrographic printer/copier described in U.S. Pat. No. 4,664,507 is to provide a machine which is reliable over an extended period of use and which is readily serviceable. To accomplish this, the machine is provided with modular units which are easily removed and replaced at specified time intervals or when they malfunction. In addition, the machine is provided with a simplified paper path whereby the paper always travels along a substantially planar path located near the top of the machine. The paper is imprinted on its underside as it travels along this paper path and passes across the top of the vertically mounted photoconductive belt.

By providing this "straight-through" paper path and "top transfer" geometry, the number of paper jams is considerably reduced. In the event a paper jam does occur, the lid of the machine can be opened and the jammed paper can be readily accessed from the top of the machine. This is in contrast to many prior art machines wherein paper jams can only be reached from the side of the machine. Additionally, because the paper is imprinted on its underside, and because the machine has a "straight-through" paper path, the paper is ejected into the output tray face down. Thus, the paper is automatically collated as it is being printed and ejected.

The present invention is similar in many respects to the electrographic printer/copier described in U.S. Pat. No. 4,664,507. It includes many of the modular components which are employed in the electrographic printer/copier of U.S. Pat. No. 4,664,507. It also includes a paper path located near the top of the machine which permits easy access from the top of the machine in case of paper jams However, the machine of the present invention is also different from the electrographic printer/copier of U.S. Pat. No. 4,664,507 in many respects as will be described hereinbelow.

The machine of the present invention is more specifically directed to an electrographic printer interfaced to a computer. With suitable changes, the device described herein can be modified so that it functions as an electrographic copying machine. However, it is most suitably adapted for printing in contrast to copying, and in particular for continuous printing. Continuous printing is accomplished by employing a seamless photoconductive drum of relatively small diameter, and by employing suitable software which controls operation of the optical print head. Since the drum is seamless, there are no predefined start/stop points on the drum and printing can begin anywhere on the drum. Thus, there is no wasted rotation of the drum. Moreover, the relatively small diameter of the drum permits it to be rotated at relatively high speed.

The machine of the present invention further includes a charged transfer belt which is aligned opposite the photoconductive drum. The charged transfer belt has a dual function. First, it creates an electric field which attracts the developed image from the photoconductive drum to the underside of a sheet of paper brought into the transfer zone. Second, the static charge on the belt retains the sheet against itself and the belt transports the sheet from the photoconductive belt to a fusing station. The combination of the top paper path, the alignment of the charged transfer belt, and the small diameter drum is such that the sheet enters and leaves the transfer zone between the drum and the transfer belt at relatively sharp angles. The transfer zone is relatively short compared to prior art electrographic printers/copiers.

Despite these differences, the electrographic printer of the present invention still resembles the printer/copier described in U.S. Pat. No. 4,664,507 in that it includes a simplified paper path located near the top lid of the machine. It also employs the same top transfer geometry of the printer/copier of U.S. Pat. No. 4,664,507 whereby the sheet of paper is imprinted on its underside as it passes across the top of the photoconductive member.

SUMMARY OF THE INVENTION

In accordance with one of its aspects, the present invention comprises an electrographic printing apparatus for producing hard copies of information to be recorded on a sheet of paper or the like. This printing apparatus includes a housing, a source of paper, an output receptacle for receiving the paper after it is imprinted, a photoconductive member for storing a latent electrostatic image of information to be imprinted, and a developer unit for developing the latent electrostatic image on the photoconductive member. The electrographic printing apparatus includes a paper path along which the paper travels between the source and the output receptacle, the paper path being located near the top of the housing. The electrographic printing apparatus further includes a combined transfer and transport unit located above the paper path. The combined transfer and transport unit cooperates with the photoconductive member to define a transfer zone wherein the developed image is transferred to the underside of the sheet of paper. The combined transfer and transport unit is also operative to separate the sheet of paper from the photoconductive member and to transport it along the paper path away from the photoconductive member after the sheet has been imprinted on its underside. Preferably, the photoconductive member comprises a photosensitive drum of reduced diameter, for example, about 30–80 mm in diameter.

In a further aspect of the invention, the combined transfer and transport unit comprises a charged transfer belt which is made from a dielectric material such as rubber. The charged transfer belt is laid out as a triangle with one leg of the triangle being contiguous with a portion of the paper path. Because of the charge on the transfer belt, this leg serves as a transport device for separating the imprinted sheet from the photoconductive member and for transporting the sheet to a fusing station. While charged transfer belts per se are known, see e.g., U.S. Pat. No. 3,907,421 (Jordan et al), it is not believed that anyone has heretofore disclosed a charged transfer belt which is laid out as a triangle, one leg of which serves as a transport unit for the sheet of paper after it has been imprinted.

In yet another aspect of the present invention, the paper path along which the sheet travels between its source and the output receptacle includes several branches. One branch of the paper path delivers the sheet to a transfer zone between the photoconductive member and the charged transfer belt from above at a first oblique upward angle. A second branch of the paper path, which is contiguous with a leg of the charged transfer belt, removes the sheet from the transfer zone at a second oblique upward angle. This second oblique angle is greater than the first oblique angle. A third branch of the paper path receives the sheet from the second branch at a third oblique angle downward from the second branch and delivers it to the fusing station. This third branch is substantially horizontal. The combination of the specified paper path, the triangular alignment of the charged transfer belt, and the small diameter of the drum defines a very short transfer zone for the sheet of paper. The entire paper path is located near the top of the machine and sheet of paper is imprinted from below.

DETAILED DESCRIPTION OF THE PREFERRED EMBODIMENTS

Figure 1:
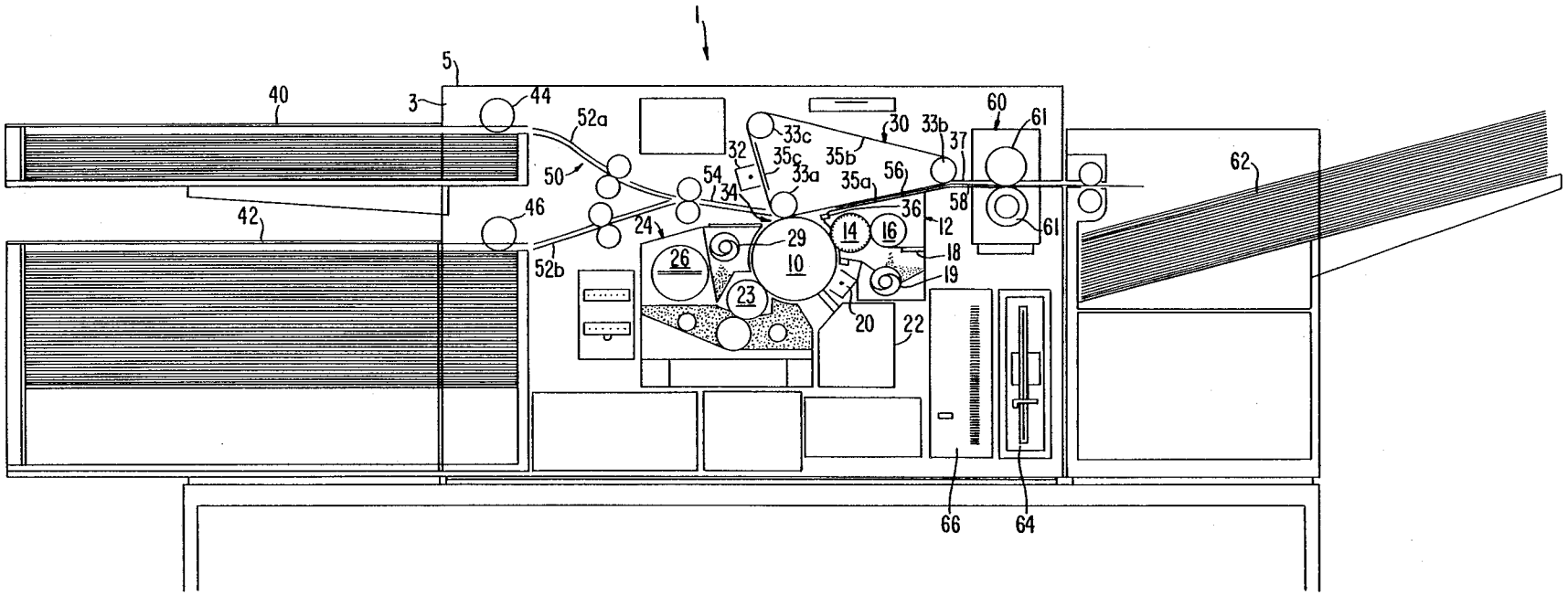
FIG. 1 is a schematic diagram of an electrographic printer employing an arrangement in accordance with the present invention.

FIG. 1 is a block diagram showing the basic components of an electrographic printer 1 in accordance with one aspect of the present invention. The electrographic printer 1 includes a housing 3 which has a top lid 5. Top lid 5 is hinged to the remainder of housing 3 so that it can swivel upwards and provides access to the inside of printer 1 in case of a paper jam.

Electrographic printer 1 includes a photosensitive drum 10 as its photoconductive member. As depicted in FIG. 1, drum 10 is of relatively small diameter and rotates in a clockwise direction. Preferably, drum 10 has a diameter in the range of about 30–80 mm, and most preferably about 60 mm in diameter. This reduced diameter allows the printing apparatus to be of compact size. The reduced diameter drum also permits a high speed of rotation and thus enables the drum to operate at speeds as high as 48 pages per minute.

Photoconductive drum 10 is seamless. The technology for producing a seamless photoconductive drum is known per se. Since there is no seam on drum 10 to mar the printed image, there are no predefined start/stop points on drum 10. Printing can begin anywhere on drum 10 and there is no wasted rotation of drum 10. Moreover, the relatively small diameter of the drum permits it to be rotated at high speeds.

Another benefit which derives from the seamless construction of drum 10 is that the circumference of the drum is not related to the paper size. Whereas in electrographic printers and copiers having drums with seams the circumference of the drum had to be correlated with the size of the paper so that the seam did not appear in the middle of a page, this is not the case for the seamless drum described herein. As a result, drum 10 may be of reduced diameter with the natural benefits flowing therefrom.

Although there is no constraint on the circumference of drum 10, it is desirable that drum 10 be at least 11" in length. This length would permit printing on many different sized papers. For example, if photoconductive drum 10 is 8½"0 in circumference (ca. 65 mm in diameter) and 11" in length, a sheet of paper 8½×11" can be printed from top to bottom with drum 10 making about 1⅓ revolutions. Alternatively, a sheet of paper 8½×11" can be printed sideways with a single revolution of drum. Similarly, a sheet of paper as large as 11"×17" can be imprinted with this drum by feeding it sideways to the drum. In this case, photoconductive drum 10 would make two revolutions per sheet imprinted.

Arrayed about drum 10 are the various units and stations which are necessary for the proper operation of this printer. Beginning at the upper right portion of drum 10 and travelling clockwise, the following units are illustrated: cleaning unit 12, main charging corona 20, optical print head 22, developer unit 24, transfer belt 30 and erase lamp 36.

Cleaning unit 12 is a modular unit which can be attached to drum 10 and which removes residual toner particles from drum 10 after the sheet has been imprinted. Cleaning unit 12 includes brush 14, metal roller 16, scraper blade 18 and auger 19. A similar modular cleaning unit is disclosed and claimed in the present assignee's U.S. patent application Ser. No. 33,457, filed Apr. 1, 1987, which is incorporated herein by reference.

Optical print head 22 comprises an LED array and a fiber optical bundle, such as that sold by Nippon Sheet Glass Co. of Japan under the name SELFOC, to focus the light on drum 10. The light image projected by optical print head 22 onto drum 10 is controlled by input signals received from a computer (not shown) and an on-board controller. The on-board controller determines whether the paper will be imprinted from top to bottom or otherwise.

Developer unit 24 is similar in construction to the developer unit described in the present assignee's U.S. Pat. No. 4,639,116, issued Jan. 27, 1987. It includes toner cartridge 26 and magnetic brush 28 which applies the toner particles to drum 10. The developer unit 24 also includes auger 29 which aids in distributing residual toner particles in the developer unit which are received from cleaning unit 12. A recycling unit (not shown) is provided for transporting residual toner particles from cleaning unit 12 to developer unit 24.

Transfer belt 30 is disposed above drum 10. Transfer belt 30 is made from an insulating dielectric material, such as rubber. A charging corona 32 is associated with transfer belt 30 and is effective for applying a biasing voltage in the range of about +1000V to +2000V to the transfer belt 30. Because it is made from a dielectric insulating material, transfer belt 30 will retain the charge applied to it by charging corona 32.

As will be observed from FIG. 1, transfer belt 30 is disposed about the rollers 33*a*, 33*b*, and 33*c* in the manner of a right triangle with each of these rollers forming a corner of the triangle. Transfer belt 30 thus has three legs 35*a*, 35*b*, and 35*c*. As will be discussed in more detail below, leg 35*a* of this triangle is tangential to drum 10 and is inclined upwardly. Leg 35*a* is contiguous with a portion of the paper path. Because of the static charge on leg 35*a* of transfer belt 30, paper is retained against this leg. Thus, leg 35*a* of transfer belt 30 serves to transport a sheet of paper away from drum 10. A scraper blade 37 is also associated with transfer belt 30. Scraper blade 37 separates the sheet of paper from transfer belt 30.

Other components of interest in electrographic printer 1 are paper input cassettes 40 and 42, paper feed rollers 44 and 46, erase lamp 37, fusing station 60 having heated roller 61 and unheated roller 61*a*, output tray 62, floppy diskette drive 64, and hard disk drive 66.

The copy material, e.g., paper, is derived from either of two convenient paper cassettes 40 and 42 by means of feed rollers 44 and 46. The paper is directed along a paper path generally shown by the numeral 50 by means of the various rollers illustrated. Paper path 50 is located near the top of housing 3. It includes a number of branches or subpaths, such as subpaths 52*a* and 52*b* which lead from cassettes 40 and 42. Subpaths 52*a* and 52*b* merge into a first main branch 54 which leads to a transfer zone 34 located between roller 33*a* of transfer belt 30 and photoconductive drum 10. Paper path 50 also includes a second main branch 56 which leads the sheet of paper out of transfer zone 34. A third main branch 58 receives the sheet from second branch 56 and transports it to fusing station 60 and from there to output tray 62.

Branch 56 of paper path 50 is contiguous with the upwardly inclined leg 35*a* of transfer belt 30. Because of the charge which is on transfer belt 30, the sheet of paper is carried along by belt 30 as it rotates in a counter-clockwise direction. There is no need for a vacuum transport unit inasmuch as the paper is retained against the upwardly inclined leg 35*a* of belt 30. No jitter of the paper occurs as it travels through transfer zone 34.

It will be observed that first branch 4 of paper path 50 leads the sheet of paper into transfer zone 34 from an upward angle. Thereafter, second branch 56 leads the paper out of the transfer zone again in a sharp upward angle. As a result of this alignment of these branches of paper path 50, as well as the arrangement of transfer belt 30 and the small diameter of drum 10, the sheet of paper travels through a very short transfer zone, i.e., the sheet of paper lies along photoconductive drum 10 for only a very short distance. This is in contrast to many prior art devices which employ large diameter drums and have large transfer zones. The small transfer zone is highly desirable since it reduces the smudging which may occur. Furthermore, smudging is also reduced by virtue of belt 30 which retains the paper in fixed alignment with the drum as opposed to vacuum transport units which introduce some jitter into the paper.

It will further be observed that third branch 58 of paper path 56 is angled somewhat downwardly from second branch 56. In the illustrated embodiment, third branch 8 is horizontal. Although the paper is retained rather firmly against transfer belt 30 because of the charge on the belt, due to the sharp separation angle between second branch 56 and third branch 58, and due to the stiffness of the paper itself, the paper will separate from belt 30 and enter into the fusing station 60. However, in order to enhance this separation, a scraper blade 37 is provided to separate the sheet from belt 30 and to guide it into fusing station 60.

The electrographic printer illustrated in FIG. 1 is a so-called "smart printer". That is, this electrographic printer contains an on-board controller which controls and coordinates each of the operations of its various components. The controller receives a variety of signals from various sensors and command stations associated with the printer and sends out a variety of signals in response thereto which coordinate the operation of the various components of the printer. Thus, the controller receives signals from various sensors to detect malfunctions in the printer and sends out signals to alert the operator to these malfunctions. The controller also interfaces with the computer terminal, as well as with the illustrated diskette drive 64 and hard disk drive 66 to control operation of optical printer 22. The disk drives serve as a buffer to store text and/or graphics downloaded from the computer. The drives also store a variety of pre-packaged down-loadable fonts and graphics packages.

The on-board controller is also effective for enabling the illustrated printer to operate as a continuous printer and to print sideways. Thus, the on-board controller coordinates the optical print head 22 with rotation of photoconductive drum 10 and input of the paper along paper path 50. Since the printer 1 operates in a bit-mapped mode, with the use of appropriate software, such as a page description language, the rotation of photoconductive drum 10 is automatically coordinated with input of the paper. This allows the printer to operate as a continuous publishing machine; printing can begin at any location along the surface of photoconductive drum 10 and in any direction, i.e., top to bottom, bottom to top, or sideways. There is no wasted rotation of drum 10.

The operation of electrographic printer 1 of the present invention will now be described by reference to FIG. 1. Initially, as photoconductive drum 10 begins its first revolution, the main charging unit 20 charges up the photosensitive surface to a uniform charging potential of, e.g., about −550V. Optical print head 22, which in the illustrative embodiment comprises an LED array, discharges selected portions of the photosensitive surface which portions correspond to informational areas. Thus, an electrostatic latent image corresponding to the informational areas to be printed is formed on photoconductive drum 10. This electrostatic latent image carries a voltage potential of, e.g., about −100V and is surrounded by −550V background regions.

As photoconductive drum 10 continues to rotate, magnetic brush 28 of developer unit 24 is switched on and toner particles carrying a negative charge of, e.g., about −100V are applied to photoconductive drum 10. The −100V toner particles are attracted to the "relatively positive" −100V latent image on photoconductive drum 10 while being repelled from the −550V background regions. The electrostatic latent image on photoconductive drum is thus developed by the toner particles to form a developed image on photoconductive drum 10.

Simultaneously with the revolution of photoconductive drum 10, transfer belt 30 is charged by means of charging corona 32 to a biasing voltage of, e.g., about +1,000V to +2,000V, and is caused to rotate in a counter-clockwise fashion about the illustrated rollers. Because transfer belt 30 is charged to a higher and "more positive" voltage, the toner particles at −100V will be attracted to transfer belt 30.

In the meantime, a sheet of paper has been guided from one of the input cassettes 40 or 42 into first branch 54 of paper path 50. The branch 54 introduces the sheet of paper into transfer zone 34 from an upward angle where the underside of the sheet of paper comes into contact with photoconductive drum 10. The high biasing voltage on belt 30 attracts the developed image from the drum 10 onto the paper and the sheet is imprinted on its underside. The charged transfer belt then retains the paper and carries it along its upwardly inclined leg 35*a* along second branch 56 of paper path 50. This upward angle is rather sharp and contributes to the short dwell time during which the paper is in contact with photoconductive drum 10. Thereafter, the paper is separated from leg 35*a* of belt 30 by means of blade 37 and the sheet enters third branch 8 of the paper path. It is carried along branch 58 to fusing station 60 and ejected from the printer into output tray 62 printed side down. In the meantime, photoconductive drum 10 continues to rotate and is discharged by erase lamp 36 and cleaned by means of cleaning unit 12.

It will be observed that the present printer has a separate and independent cleaning unit and thus operates as a single-pass machine, in contrast to the electrographic printer disclosed and claimed in the present assignee's U.S. Pat. No. 4,664,507, which is a two-pass machine. That machine does not include a separate and independent cleaning unit, but has a developing unit which alternates between a developing mode and a cleaning mode.

In the machine of the present invention, the belt 30 is attached to the lid 5 of housing 1. Thus, when the lid 5 is lifted, the belt 30 is lifted as well and easy access to the paper path is obtained.

The machine of the present invention can be adapted for duplex printing, i.e., printing on both sides of a single sheet of paper. A suitable duplexing unit which can be incorporated into the electrographic printer of the present invention is disclosed in the present assignee's U.S. patent application Ser. No. 39,464, filed Apr. 16, 1987.

While the invention has been described by reference to specific embodiments, this was for purposes of illustration only and should not be construed to limit the spirit or the scope of the invention.

We claim:

1. An electrographic printing apparatus for producing hard copies of information to be recorded on a sheet of paper or the like, comprising, a housing, a source of paper and an output receptacle for receiving said paper after it is imprinted, a paper path along which said paper travels between said source and said output receptacle, a photoconductive member for storing a latent electrostatic image of the information to be imprinted, developer means for developing said latent electrostatic image on said photoconductive member, and combined transfer and transport means associated with said photoconductive member, said combined transfer and transport means being located above said paper path and transporting said paper from above, said combined transfer and transport means cooperating with said photoconductive member to define a transfer zone wherein said developed image is transferred to said paper, said combined transfer and transport means being operative to separate said paper from said photoconductive member and to transport said paper along said paper path away from said photoconductive member.

2. The electrographic printing apparatus of claim 1 wherein said paper path is located near the top of said housing and said photoconductive member is located below said paper path, said photoconductive member coming into contact with the underside of said paper.

3. The electrographic printing apparatus of claim 2 wherein said photoconductive member comprises a photosensitive drum.

4. The electrographic printing apparatus of claim 3 wherein said drum is seamless.

5. The electrographic printing apparatus of claim 4 wherein said drum has a diameter in the range of about 30–80 mm.

6. The electrographic printing apparatus of claim 1 wherein said combined transfer and transport means comprises a charged transfer belt.

7. The electrographic printing apparatus of claim 6 wherein said transfer belt is disposed as a triangle above said paper path.

8. The electrographic printing apparatus of claim 7 wherein one leg of said triangle forms a portion of said paper path, said one leg being disposed tangentially to said photoconductive member.

9. The electrographic printing apparatus of claim 8 wherein said one leg is inclined upwardly relative to said photoconductive member.

10. The electrographic printing apparatus of claim 9 wherein said transfer zone is formed between a corner of said triangle and said photoconductive member, said corner being an end of said one leg.

11. The electrographic printing apparatus of claim 10 wherein said triangle is a right triangle.

12. An electrographic printing apparatus for producing hard copies of information to be recorded on a sheet of paper or the like, comprising a housing, a source of paper and an output receptacle for receiving said paper after it is imprinted, a photoconductive member, means for charging said photoconductive member, means for selectively discharging portions of said photoconductive member to form a latent electrostatic image thereon, developing means for producing a developed image on said photoconductive member, transfer means for transferring said developed image from said photoconductive member to said paper in a transfer zone located between said transfer means and said photoconductive member, said transfer means comprising a charged transfer belt disposed as a triangle above said photoconductive member, and a paper path along which said paper travels between said source and said output receptacle, said paper path being operative to transport said paper through said transfer zone between said transfer belt and said photoconductive member.

13. The electrographic printing apparatus of claim 12 wherein said photoconductive member comprises a photosensitive drum.

14. The electrographic printing apparatus of claim 13 wherein said drum is seamless.

15. The electrographic printing apparatus of claim 14 wherein said drum has a diameter in the range of about 30–80 mm.

16. The electrographic printing apparatus of clam 13 wherein said paper path is located near the top of said housing and said drum is located below said paper path, said drum coming into contact with the underside of said paper.

17. The electrographic printing apparatus of claim 16 wherein one leg of said triangle forms a portion of said paper path, said one leg being disposed tangentially to said drum.

18. The electrographic printing apparatus of claim 17 wherein said one leg is inclined upwardly relative to said drum.

19. The electrographic printing apparatus of claim 18 wherein said transfer zone is formed between a corner of said triangle and said drum, said corner being an end of said one leg.

20. The electrographic printing apparatus of claim 19 wherein said triangle is a right triangle.

21. An electrographic printing apparatus for producing hard copies of information to be recorded on a sheet of paper or the like, comprising a housing, a source of paper and an output receptacle for receiving said paper after it is imprinted, a photoconductive member, means for charging said photoconductive member, means for selectively discharging portions of said photoconductive member to form a latent electrostatic image thereon, developing means for producing a developed image on said photoconductive member, transfer means for transferring said developed image from said photoconductive member to said paper in a transfer zone, and a paper path along which said paper travels between said source on one side of said housing and said output receptacle located on an opposite side of said housing, said paper path being located near the top of said housing and said photoconductive member being located below said paper path, said photoconductive member coming into contact with the underside of said paper, said paper path being operative to transport said paper through said transfer zone, said paper path including a first branch delivering said paper to said transfer zone from a first upward angle, said paper path including a second branch removing said paper from said transfer zone at a second upward angle.

22. The electrographic printing apparatus of claim 21 wherein said second angle is greater than said first angle.

23. The electrographic printing apparatus of claim 22 wherein said paper path includes a third branch receiving said paper from said second branch at a third angle downward from said second branch.

24. The electrographic printing apparatus of claim 23 wherein said third branch is substantially horizontal.

25. The electrographic printing apparatus of claim 21 wherein said photoconductive member comprises a photosensitive drum.

26. The electrographic printing apparatus of claim 25 wherein said drum is seamless.

27. The electrographic printing apparatus of claim 26 wherein said drum has a diameter in the range of 30–80 mm.

28. The electrographic printing apparatus of claim 27 wherein said transfer means comprises a charged transfer belt.

29. The electrographic printing apparatus of claim 28 wherein said charged transfer belt is disposed as a triangle opposite said drum, said transfer zone being located between said charged transfer belt and said drum.

30. The electrographic printing apparatus of claim 29 wherein one leg of said charged transfer belt is contiguous with said second branch of said paper path.

31. An electrographic printing apparatus for producing hard copies of information to be recorded on a sheet of paper or the like, comprising a housing, a source of paper and an output receptacle for receiving said paper after it is imprinted, a photoconductive member, means for charging said photoconductive member, optical light means for selectively discharging portion of said photoconductive member to form a latent electrostatic image thereon in response to electronic signals, developer means for developing said latent electrostatic image on said photoconductive member, a paper path along which said paper travels between said source and said output receptacle, and combined transfer and transport means associated with said photoconductive member, said combined transfer and transport means cooperating with said photoconductive member to define a transfer zone wherein said developed image is transferred to said paper, said combined transfer and transport means being operative to separate said paper from said conductive member and to transport said paper along said paper path away from said photoconductive member, said paper path being operative to transport said paper through said transfer zone.

32. The electrographic printing apparatus of claim 31 wherein said paper path is located near the top of said housing and said photoconductive member is located below said paper path, said photoconductive member coming into contact with the underside of said paper.

33. The electrographic printing apparatus of claim 31 wherein said photoconductive member comprises a seamless drum.

34. The electrographic printing apparatus of claim 33 wherein said drum has a diameter in the range of about 30–80 mm.

35. The electrographic printing apparatus of claim 31 wherein said combined transfer and transport means comprises a charged transfer belt.

36. The electrographic printing apparatus of claim 31 wherein said combined transfer and transport means comprises a charged transfer belt disposed as a triangle above said paper path.

37. The electrographic printing apparatus of claim 36 wherein one leg of said triangle forms a portion of said paper path, said one leg being disposed tangentially to said photoconductive member.

38. The electrographic printing apparatus of claim 37 wherein said one leg is inclined upwardly relative to said photoconductive member and is operative to transport said paper away from said photoconductive member.

39. The electrographic printing apparatus of claim 38 wherein said transfer zone is formed between a corner of said triangle and said photoconductive member, said corner being an end of said one leg.

40. The electrographic printing apparatus of claim 39 wherein said paper path includes a branch for delivering said paper to said transfer zone from an upward angle.

41. An electrographic printing apparatus for producing hard copies of information to be recorded on a sheet of paper or the like, comprising a housing including a liftable lid at the top of said housing, a source of paper and an output receptacle for receiving said paper after it is imprinted, a paper path along which said paper travels between said source and said output receptacle, a photoconductive member for storing a latent electrostatic image of the information to be imprinted, developing means for developing said latent electrostatic image on said photoconductive member, and combined transfer and transport means associated with said photoconductive member, said combined transfer and transport means being attached to and being liftable with said lid, said combined transfer and transport means cooperating with said photoconductive member to define a transfer zone wherein said developed image is transferred to said paper, said combined transfer and transport means being operative to separate said paper from said photoconductive member and to transport said paper along said paper path away from said photoconductive member.

* * * * *